US005485058A

United States Patent [19]

Watson et al.

[11] Patent Number: 5,485,058

[45] Date of Patent: Jan. 16, 1996

[54] TOUCH DIMMER SYSTEM

[75] Inventors: Douglas R. Watson, Sanford, Conn.; Lev Bogorad, Roosevelt Island, N.Y.; Albert Lombardi, LaGrangeville, N.Y.; Benjamin Neiger, Floral Pk., N.Y.; Lester Rivera, Glendale, N.Y.; Joseph G. Justiniano, Bethpage, N.Y.; Zvi Aluma, Plainview, N.Y.

[73] Assignee: Leviton Manufacturing Co., Inc., Little Neck, N.Y.

[21] Appl. No.: 286,613

[22] Filed: Aug. 5, 1994

Related U.S. Application Data

[63] Continuation of Ser. No. 975,371, Nov. 12, 1992, Pat. No. 5,336,979.

[51] Int. Cl.[6] ..... G05F 1/00

[52] U.S. Cl. ..... 315/194; 315/362; 315/291; 315/307; 315/208; 315/DIG. 4

[58] Field of Search ..... 315/362, 194, 315/291, 307, DIG. 4, 208, 293, 297

[56] References Cited

U.S. PATENT DOCUMENTS

| | | | |
|---|---|---|---|
| Re. 30,296 | 6/1980 | Kirby et al. | 315/194 |
| 3,968,401 | 7/1976 | Bryant | 315/293 |
| 4,241,295 | 12/1980 | Williams, Jr. | 315/294 |
| 4,289,972 | 9/1981 | Wern | 307/116 |
| 4,396,869 | 8/1983 | Rosenbaum et al. | 315/194 |
| 4,743,138 | 3/1987 | Pearlman et al. | 315/307 |
| 5,030,890 | 7/1991 | Johnson | 315/208 |
| 5,264,761 | 11/1993 | Johnson | 315/291 |

OTHER PUBLICATIONS

"100 Touch Dimmer", Siomens Model S8759, Published in Elektor, vol. 4, No. 7–8; 7–90 (Jul./Aug. 1978).

*Primary Examiner*—Robert J. Pascal
*Assistant Examiner*—Haissa Philogene
*Attorney, Agent, or Firm*—Paul J. Sutton

[57] ABSTRACT

A key touch dimmer includes a switching device through which AC line current is passed to brighten a lamp in response to a control signal generated by a microprocessor. The microprocessor receives an input indicative of the zero crossing points of the AC line current and synchronizes this input with its own internal clock circuitry to generate a firing signal for the switching device at the correct phase angle in the next half cycle of the AC line current. The dimmer has memory capability whereby the lamp, when turned back on, will brighten to a preset level. This brightening is accomplished in a gradual manner. Likewise, a turned off lamp will fade to zero brightness, with the dimmer retaining the preset brightness level. The microprocessor shuts down quickly in the event of a power outage to preserve memory. An optional display includes a plurality of LEDs for indicating light level. Other options include providing the dimmer with several keys, each of which can be adjusted to a respective preset level.

1 Claim, 9 Drawing Sheets

TOUCH DIMMER SYSTEM

This is a continuation of application Ser. No. 07/975,371 filed Nov. 12, 1992, U.S. Pat. No. 5,336,979.

BACKGROUND OF THE INVENTION

The present invention relates to a touch dimmer system of single or multiple-key embodiment for controlling the brightness of an electric lamp or plurality of lamps.

Known in the art is a dimmer comprising a variable voltage power supply having an input adapted to be connected to an alternating voltage and an output, a latching switch means having one terminal connected to the input and another terminal connected to the output and a control terminal to which a control voltage is applied for latching the switch in a closed condition at a preset time in a sub-cycle of the line alternating voltage. The switch means, which can be a triac, changes to an open state from a closed state to interrupt current flow to the output of the power supply during the zero crossing which terminates the alternating voltage sub-cycle. The control circuit requires a source of periodic signals and a counter to which signals are applied for incrementing and then decrementing the count in the counter between lower and upper counting limits in response to application of a level-setting constant voltage applied to an input of the control circuit for a period of time until the desired output voltage of the power supply is reached. When used to control a lamp, the variable voltage power supply functions for example, to light the lamp, by touching a step function signal generator momentarily. This causes the lamp to be lit at its previous brightness level. To change the brightness level of the lamp, the step function generator is held for a longer time whereupon the light cycles through brightness levels until the desired one is reached whereupon the step function signal generator can be released and memory will retain the latest brightness level.

Also known is a dimmer comprising a microcomputer controlled light level intensity switch which is operated by a pair of non-latching switches which provide inputs to the microcomputer. The non-latching switches may be arranged as upper and lower switches on a rocker panel. When the switch is depressed in either the up or down direction with a brief tap, the microcomputer will cause the level of light intensity to automatically advance or "fade" toward a predetermined level. The fade rate is adjustable. Also, if the switch is tapped again while the light intensity is fading towards the preset level (which is set by holding the switch as the light level changes until the desired level is reached), the microcomputer will halt the fading and cause the light intensity level to abruptly shift to the preset level.

Also known is an electric dimmer with touch keys wherein a triac which can be used to regulate the brightness of lamps is controlled by an integrated circuit having a voltage controlled oscillator therein which responds to currents generated by finger touching of the dimmer touch keys as well as the line voltage to assure that a specific phase angle drive to the triac is applied. A memory circuit retains this angle indefinitely, in the absence of power interruption.

Still another known dimmer includes a control circuit for raising or lowering the intensity of a group of lights at a desired fade rate. The control circuit comprises at its inputs a variable frequency pulse generator and a raise/lower enable circuit. The raise/lower enable circuit provides a first enabling signal which enables a gating means to apply the clock pulses generated by the pulse generator means to the up input terminal of an up/down counter. Another enabling signal enables a gate means which applies the clock pulses generated by the pulse generator to the down input terminal of the up/down counter. The up/down counter calculates the difference between the number of up pulses and down pulses and generates a digital signal representative of the evaluation. Finally, digital to analog converter means generate an analog output control signal to control the fade rate of the light through the dimmer.

Yet another known dimmer includes a control circuit for a triac-type dimmer which in turn controls a plurality of lamps. A trigger pulse generator provides a trigger pulse for each triac-type dimmer, the phase angle of which pulse is a function of a binary encoded intensity indicating signal. The intensity indicating signal and a time based signal are combined in a trigger pulse generator to produce the trigger pulse which is applied to the gate of the triac, with the object being to deliver the appropriate power to the lamp to maintain its desired brightness regardless of changes in the line voltage.

Still another known dimmer discloses a touch control switch for incandescent lighting wherein a triac controls the brightness of an incandescent lamp, with the triac having a gate input circuit comprising a counting circuit with a forward stepping input and a digital control input, as well as a trigger pulse generating circuit for controlling the conduction of the triac in accordance with the condition of activation of the digital control output.

SUMMARY OF THE INVENTION

The present invention, which comprises improvements upon the design shown in the aforementioned Rosenbaum et al. U.S. Pat. No. 4,396,869 patent, assigned to the assignee of the present invention, teaches a microprocessor controlled light level dimmer wherein a switching device such as a triac is used to control the brightness level of one or more lamps. The gate to the switching device is controlled by the microprocessor.

The control circuitry in the dimmer includes a zero crossing circuit for generating a stepped zero crossing signal which is conveyed to the microprocessor, an output circuit connected to the microprocessor to receive a triggering signal therefrom and to thereupon generate a switching signal which is applied to the control terminal of the switching device, as well as a power supply circuit connected to an AC line voltage and to the zero crossing circuit, the power supply circuit functioning to interrupt current flow through the switching means when voltage from the AC line voltage source reaches a certain level or when a predetermined time has elapsed since the most recent of the zero crossing points of the AC line voltage source.

The control circuitry further includes a voltage level indicator circuit which sends a first signal to the microprocessor when a certain voltage within the circuit reaches a predetermined level, and a second signal to indicate whether the voltage was rising or falling when it reached the predetermined level. If the voltage is falling, the microprocessor assumes that a power outage has occurred and goes into a HALT mode to save preset light brightness levels stored in its memory. If the voltage is rising, it first checks the memory and, if the information is lost, delivers a signal whereby the lamp, when turned on, will gradually brighten from a minimum level to its maximum brightness level.

A two key dimmer embodiment in accordance with the invention operates such that, to turn the light on, the upper of two rockers is tapped for a short time whereupon the light gradually brightens or "fades" from off to a preset level. To turn the light off, the lower rocker is tapped for a short time, whereupon the light fades off. The preset level is retained in the memory of the microprocessor. To attain the preset level, if the light is already on, the upper rocker is pressed and held such that the brightness gradually increases to a higher level. Likewise, holding of the lower rocker causes the light to fade to a lower level. A minimum brightness level for the light is adjustable.

A three key dimmer embodiment of the present invention comprises an on/off key switch. To turn the light on, the on/off switch is pushed whereupon the light gradually brightens to a preset level. In contrast, to turn the light off, the on/off switch is pushed whereupon the light fades off and the aforementioned preset level is retained in the memory of the microprocessor. To set the aforementioned preset level, an upper rocker of two rockers is held to increase brightness, whereas the lower of the two rockers is held to decrease brightness. The minimum brightness level for the light is adjustable.

A five key dimmer embodiment of the present invention comprises a plurality of level selection key switches, a level adjustment key switch, and an on/off key switch, as well as a plurality of brightness level indicators (LEDs). In this embodiment, to turn the light on to a previously selected brightness level, the on/off switch is pushed whereupon the light brightness gradually changes from off to the previously selected brightness level. To turn a light on to one of a plurality of four possible preset levels, the proper level selection key is pushed whereupon the light gradually brightens from off to a particular preset brightness level. To turn the light off, the on/off switch is pushed whereupon the light fades off. By pushing the proper level select key, the lamp can switch from one preset brightness light level to another in a gradual, as opposed to instantaneous, manner. A light level for a particular level selection key can be attained by first holding the proper level selection key, then pressing the level adjustment key whereupon the light will dim or brighten until the key is released when a desired brightness level is attained. The minimum brightness level is adjustable.

A particularly advantageous feature is the brightness level preset indicator (LEDS) of the two key dimmer and three key dimmer embodiments of the present invention is that they function to indicate the lamp brightness level or levels whether or not the dimmer is activated.

DESCRIPTION OF THE PREFERRED EMBODIMENTS

Figure 1B:
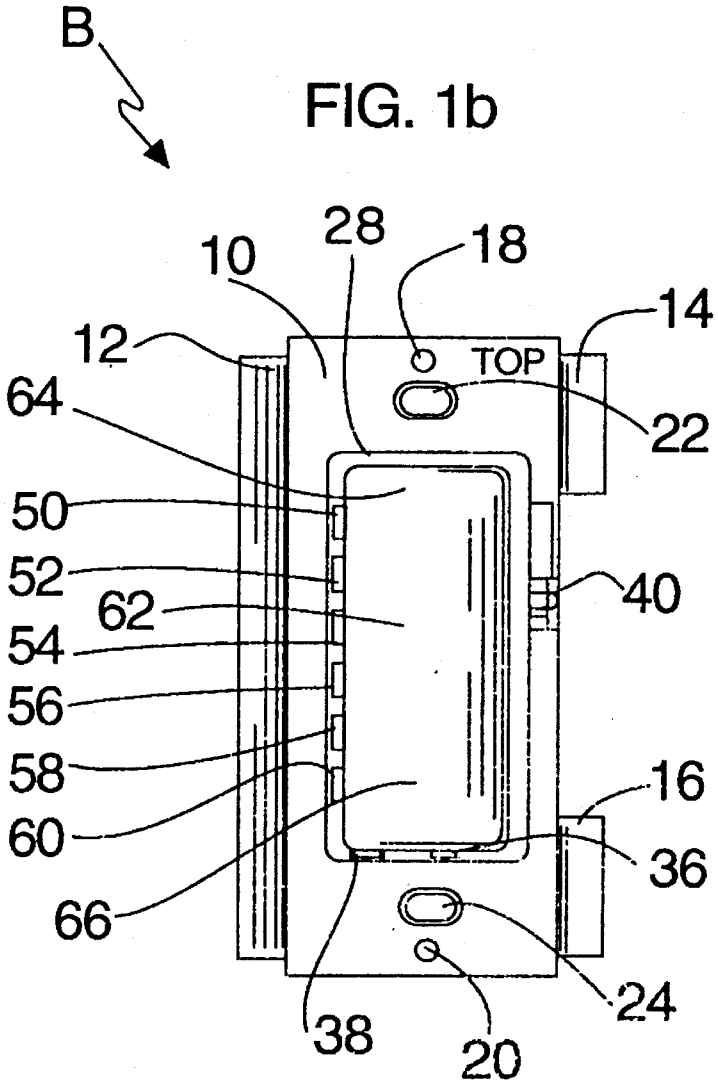
FIG. 1*b* is a front view of a two key dimmer with an LED display for level indication.

Throughout the drawings identical elements are identified by the same reference numerals.

The dimmers shown in FIGS. 1A, 1B, 2A, 2B, and 3A–3B are respectively distinguished by reference characters A, B, C, D, and E. All of the multiple key dimmers A–E have a common modular construction comprising cover plate 10, flanges 12, 14, and 16, threaded mounting holes 18 and 20, and apertures 22 and 24.

Figure 1A:
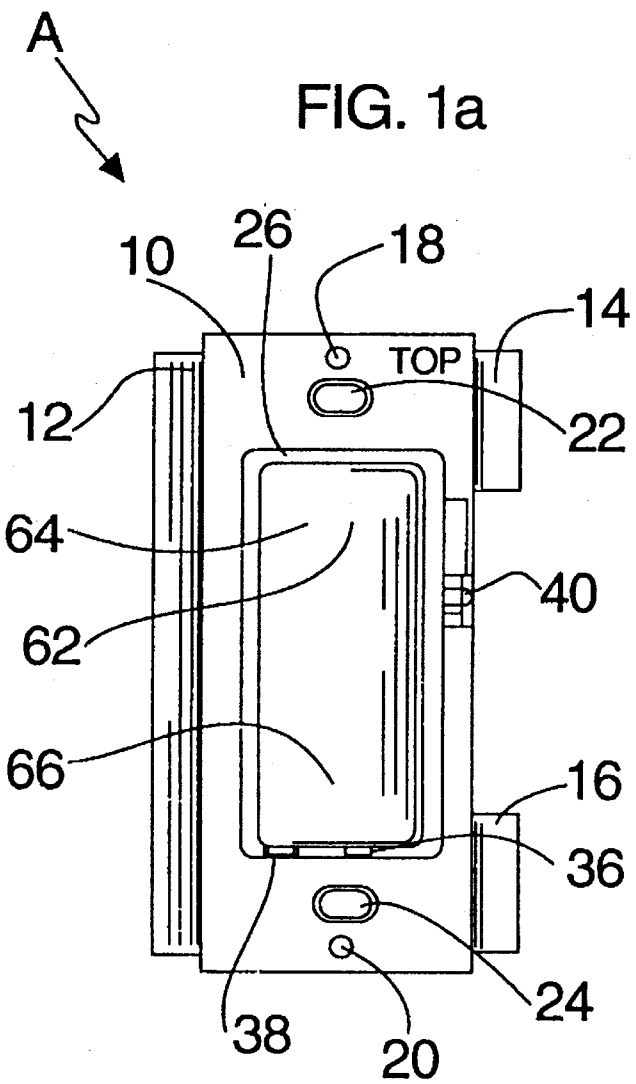
FIG. 1*a* is a front view of a two key dimmer according to the present invention.

Referring specifically to the two key dimmers shown in FIGS. 1A and 1B, these dimmers differ in that the dimmers shown in FIG. 1B have brightness level indication as provided by LEDs 50, 52, 54, 56, 58 and 60. Otherwise, these dimmers are alike in structure and function, as will be explained hereinafter.

Each of the two key dimmers A, B, has a respective touch panel 26, 28 comprising an upper rocker portion 64 and a lower rocker portion 66. For operation of the dimmer, the air gap switch 38, common to all of the embodiments shown herein, should be on. The on/off LED 36, which is also common to all embodiments of the multiple key dimmer shown herein, is on when the controlled light is on and off when the controlled light is off.

The two key dimmers shown in FIGS. 1A and 1B operate such that, to turn the light on, the upper rocker 64 is tapped for a short time (less than one second) whereupon the light brightens or "fades" in a gradual manner from off to a preset level. To turn the light off, the lower rocker 66 is tapped for a short time whereupon the light fades off. The preset level is retained in the memory of the microprocessor 68 provided as part of the logic circuitry for the unit.

To attain the aforementioned preset level, if the light is already on, the upper rocker 64 is pressed and held such that the brightness gradually rises or "fades" to a higher level. Holding of the lower rocker causes the light to fade to a lower level. If the light is off, the upper rocker is first tapped to turn the light on and then either the upper or lower rockers 64, 66 are held to set the preset level in the aforementioned manner. If one of the rockers is activated during brightening or dimming of the light, the adjustment up or down is made starting from the brightness level at the moment of activation.

If it is desirable to set the level of a switched off light starting from a minimum brightness level the upper rocker 64 should be pressed and held. The light then turns on at the minimum brightness level and gradually rises to brighter levels as long as the rocker is held.

The lowest brightness setting attainable is limited by the aforementioned minimum brightness level, which is adjustable. To adjust the minimum brightness level, the light is turned on, and then the minimum adjustment key 40, which is common to all embodiments of the multiple key dimmer shown herein, is pressed and held to adjust the level, while holding the respective upper or lower rocker 64, 66, depending respectively on whether the minimum brightness level is to be increased or decreased. Then in sequence the rocker is released and the minimum adjustment key 40 is released after the desired brightness is attained. The minimum brightness level cannot be adjusted to a value higher than about ⅓ of the maximum brightness level.

As mentioned previously, the dimmer B shown in FIG. 1B is similar in operation to the dimmer shown in FIG. 1A except that touch panel 28 has a plurality of light emitting diodes (LEDs) 5C, 52, 54, 56, 58 and 60 to indicate the preset level. One of these LEDs is on to indicate the preset brightness level to an accuracy within the limits of its range. In other words, the one of the six LEDs 50–60 which lights up is the closest to the preset brightness level. The six LEDs 50–60 are located vertically such that, the higher the LED which is lit, the higher is the preset brightness level. The LED which indicates the preset level is on whether or not the controlled unit is on.

All of the embodiments of the multiple key dimmer embodiments discussed herein can be provided as master units and slave units with the slave units operating in the same fashion as the master unit except that minimum adjustment means and LED displays are not provided on the slave units.

Figure 2B:
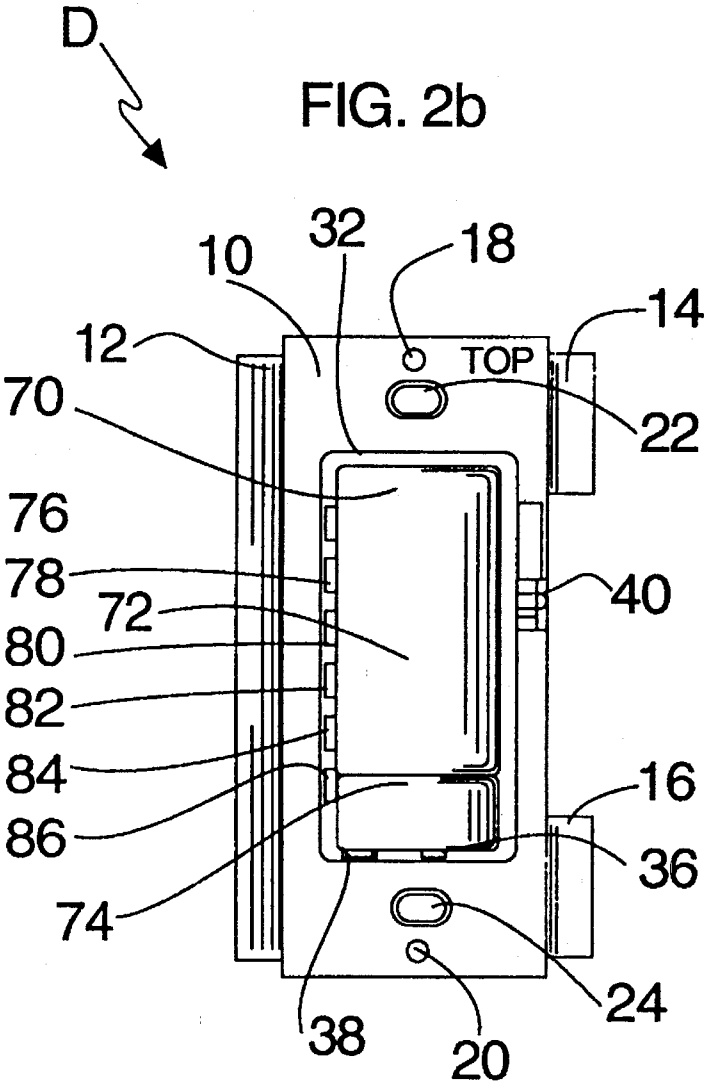
FIG. 2*b* is a front view of a three key dimmer with an LED display for level indication.
Figure 2A:
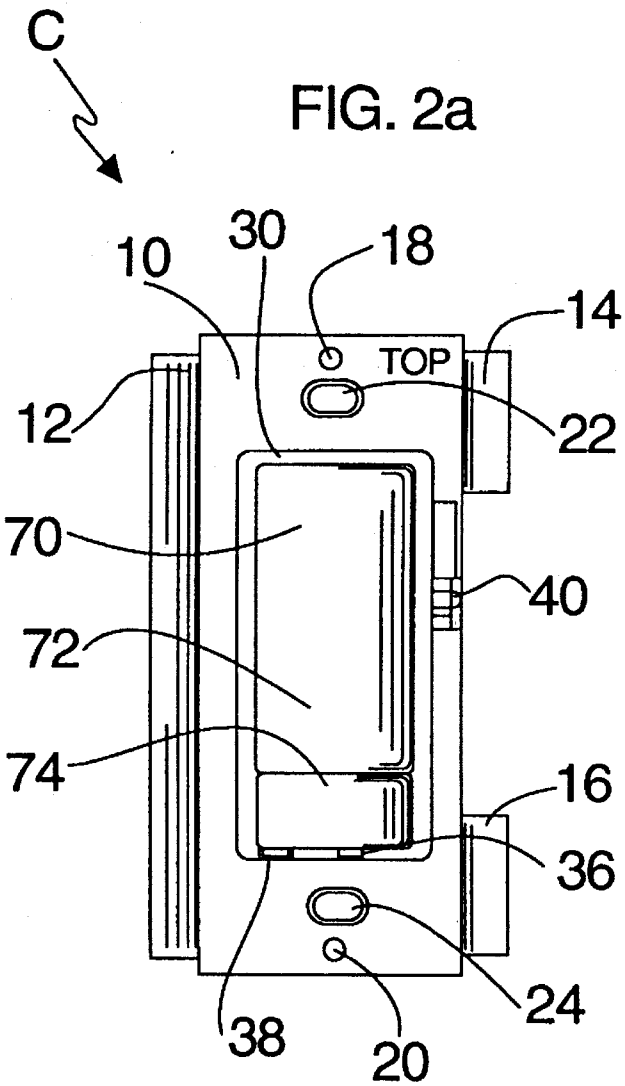
FIG. 2*a* is a front view of a three key dimmer according to the present invention.

The three key dimmers C, D shown in FIGS. 2A and 2B are similar in structure and operation, except that touch panel 32 of FIG. 2B has illumination means comprising six LED brightness level indicators 76, 78, 80, 82, 84, and 86.

For operation of the three key dimmers, the air gap switch 38 should first be on (the switch actuator should be pushed in). Then, to turn the light on, the on/off key switch 74 is pushed whereupon the light brightens in a "fade" manner from off to a preset level. In contrast, to turn the light off, the on/off switch 74 is pushed whereupon the light fades off and the aforementioned preset level is retained in the memory of the microprocessor 68. To set the aforementioned preset level, the upper rocker 70 is held to increase brightness, whereas the lower rocker 72 is held to decrease brightness.

Figure 3B:
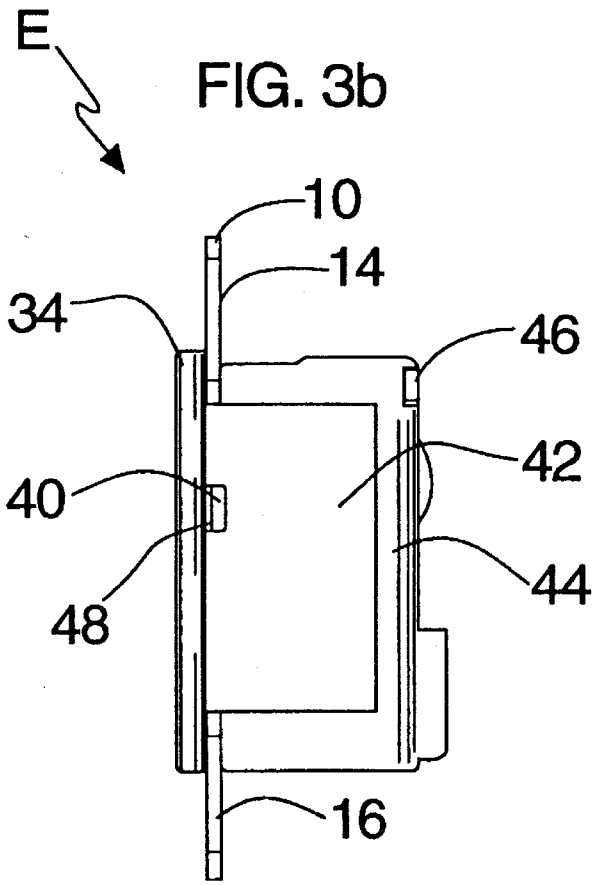
FIG. 3*b* is a side view of the dimmer of FIG. 3*a*.
Figure 3A:
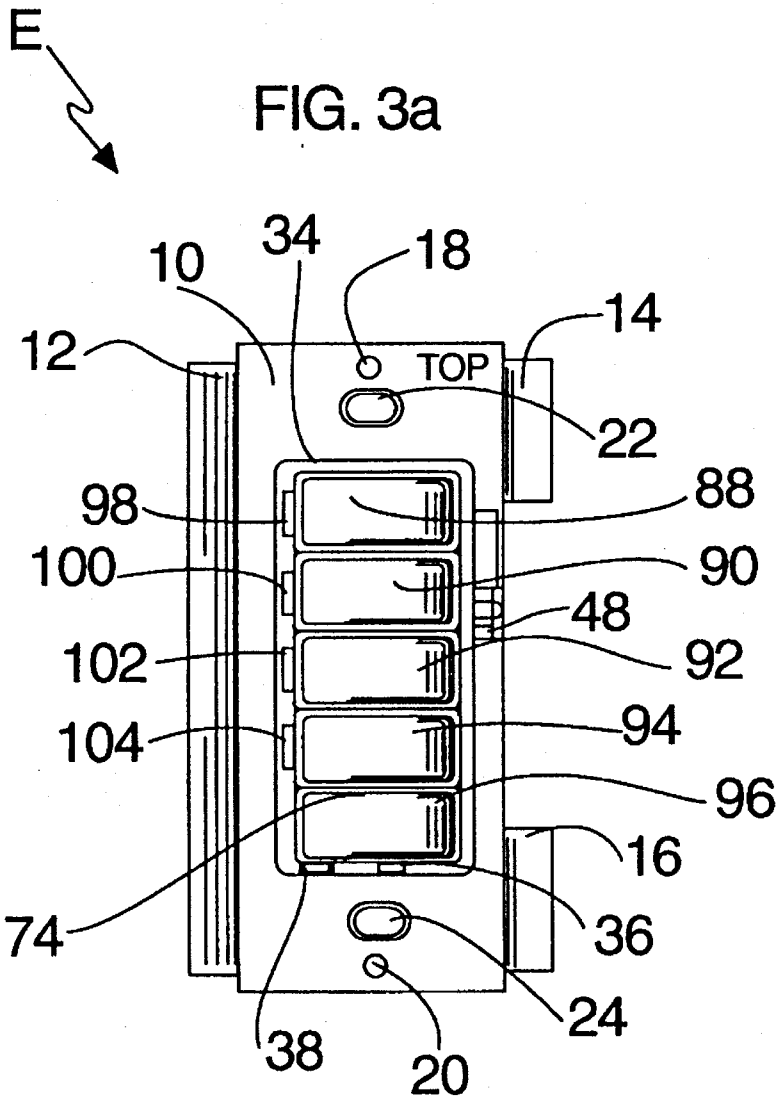
FIG. 3*a* is a front view of a five key embodiment of the present invention.

Whereas the dimmer D shown in FIG. 3B has an LED display 76–86 which can be set with the control light either on or off, the dimmer shown in FIG. 3A can be set only with the controlled light on. For both the dimmers shown in FIGS. 3A and 3B, closure of the rocker switch interrupts fading or brightening and starts level setting beginning from the current brightness level.

In each of the three key dimmers, the lower setting is limited by a minimum brightness level, which is adjustable. To adjust the minimum brightness level, the light should first be turned on, then the minimum adjustment key 40 should be pressed and held while the minimum brightness is adjusted by holding the upper rocker 70 if a higher minimum brightness level is desired or the lower rocker 72 if a lower minimum brightness level is desired. After the minimum brightness level is reached, the rocker is first released and then the minimum adjustment key 40 is released. As with the aforementioned two key dimmers, the minimum brightness level cannot be adjusted to a value of higher than about ⅓ of the maximum brightness possible.

For the dimmer D shown in FIG. 3B which is provided with an LED display 76–86, the on/off LED 36 is on if the controlled light is off and it is off if the control light is on. As with the aforementioned two key dimmer, shown in FIG. 1B, one of the six "level" LEDs 76–86 indicates the preset brightness level. Also, as with the two key dimmer of FIG. 1B, the higher the LED is on the panel, the higher is the preset brightness level. This brightness level indicator remains on whether or not the controlled light is on.

A five key dimmer E is shown in FIGS. 3A and 3B. comprises a touch panel 34 having a plurality of level selection keys 88, 90, 92, and 94, respectively, as well as an on/off key switch thereon. The dimmer also comprises a level adjustment key 48 mounted on a plate 42 which extends around the circuitry housing 44 as shown in FIG. 3B. Housing 44 comprises a plurality of molded sections, with assembly screw 46 being shown in FIG. 3B. The touch panel 34 of the five key dimmer shown in FIGS. 3A and 3B also comprises a plurality of level indicating LEDs 98, 100, 102, and 104. The five key dimmer E operates in the following manner:

To turn the light on to a previously selected brightness, the on/off key switch 96 should be pushed whereupon the light brightness changes from off to a previously selected brightness level. To turn the light on to one of four possible preset levels, the proper level selection key 88, 90, 92, or 94 should be pushed whereupon the light gradually brightens from off to a particular preset brightness level. To turn the light off, the on/off key switch 96 should be pushed whereupon the light fades off. This unit possesses the capability of switching from one preset light level to another preset light brightness level by pushing the proper level select key 98–104 whereupon the light dims or brightens in a "fade" gradual manner from the current preset level to the selected preset level.

To assign a light brightness level for a particular level selection key, the proper level selection key 98–104 should first be held. Then the level adjustment key 48 should be pressed and held whereupon the light will dim or brighten. The level adjustment key 48 should be released when a desired level is reached whereupon the level selection key 98–104 can subsequently be released. To change the directions of the brightness adjustment key, the level adjustment key 48 should be released and then pressed again while the level selection key 88–94 remains held.

The lowest light level selection is limited by a minimum brightness level, which is adjustable. For adjusting the minimum brightness level, the level adjustment key 48 is held whereupon the light will fade or brighten. The level adjustment key 48 should be released when the desired level is reached. To change the direction of the brightness adjustment, the level adjustment key 48 should be released and pressed again.

If the newly adjusted minimum brightness level is greater than any of the preset levels associated with a particular level selection key 88–94, this preset level will automatically be changed to the new minimum brightness level.

With regard to the display, the on/off LED 36 is held on if the controlled light is off and it is off when the controlled light is on. One of the four level LEDs 88–94 indicates which level was last selected, with the uppermost LED 98 being on the level associated with the uppermost level selection key 88.

Figure 4A:
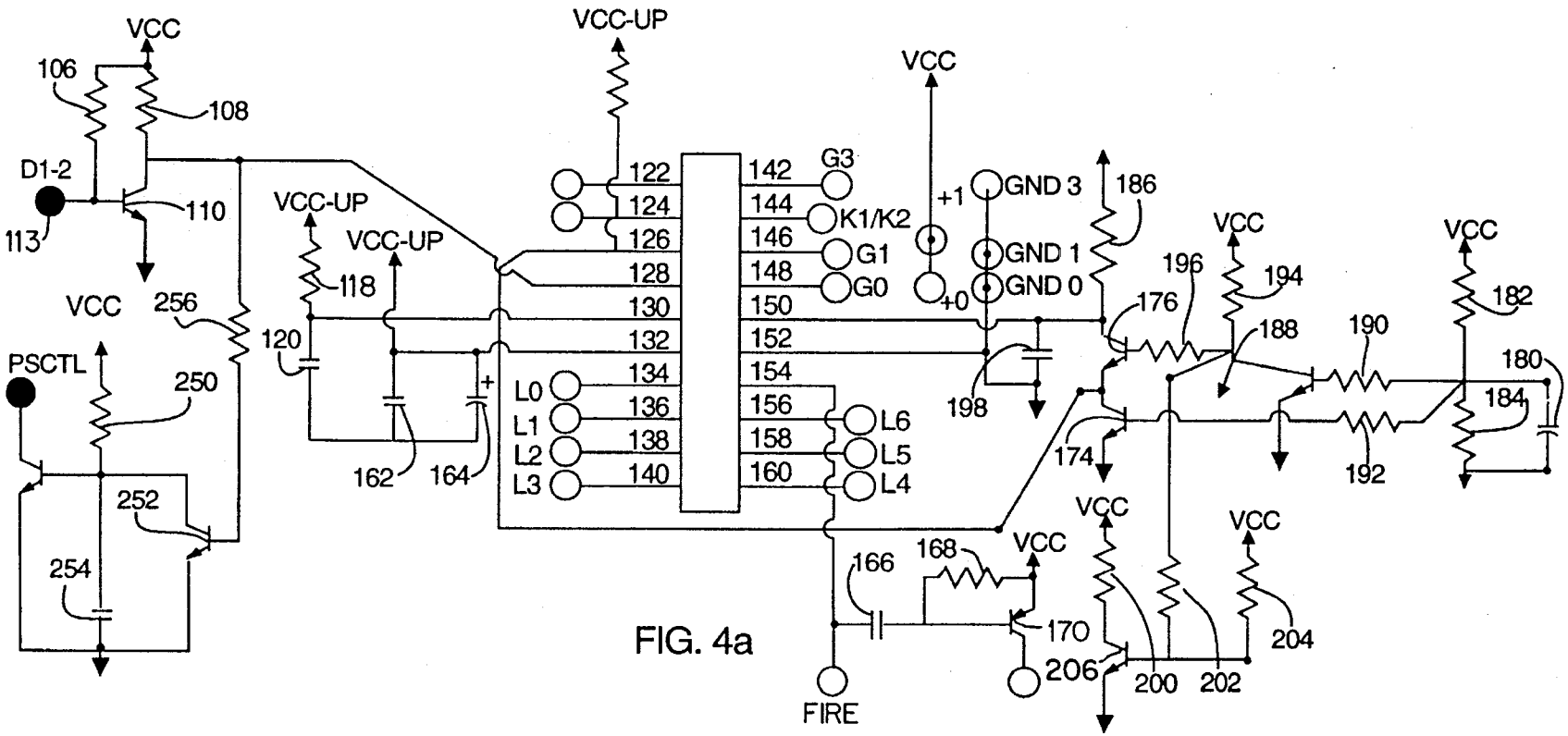
FIG. 4*a* is a schematic diagram of the logic circuit and the power supply circuit for the dimmer of the present invention.

FIGS. **4*a*, 4*b*, and 4*c* respectively comprise a logic circuit portion, a power supply portion, and a triac portion which circuits are interconnected with each other and which can be used with any of the dimmer embodiments described herein. As shown in FIG. 4*a*, resistors 106 and 108, as well as transistor 110, function as part of a zero crossing detector in converting the AC line waveform to a square wave of zero to five volts which is then conveyed to an input 128 of microprocessor 68. The microprocessor 68 measures the time between zero crossing points of the AC wave, synchronizes it with its own internal clock, and thus determines when in the next half cycle a firing signal should be sent to triac 172** (FIG. 4*c*) to maintain a constant phase angle for conduction of the AC line current through the triac into a lamp 224, whereby constant brightness in the lamp is maintained. If the microprocessor receives signals from the keys in the dimmer circuitry such as keys 300, 302 in the two key dimmer (through key terminal K, connected to microprocessor terminal 144), it varies the triac firing phase angle incrementally during half cycles of the input wave Tek to achieve both a desired level of brightness and to achieve a desired "fading" rate at which the light level advances toward the desired level of brightness. This is accomplished by the microprocessor measuring the time between AC power line crosses and multiplying it by a factor based on the preset brightness signal to determine at what point in the half cycle the triac should fire. Thus, despite wide variations in the operating frequency of the microprocessor, which might typically range from 3 megahertz to 10 megahertz, the firing angle and, consequently, the brightness of the bulb will not change in the absence of a keying instruction requiring a change.

The use of the basic operating clock frequency of the microprocessor to generate the firing signal for the triac obviates the need for a separate oscillator in the dimmer.

Figure 4B:
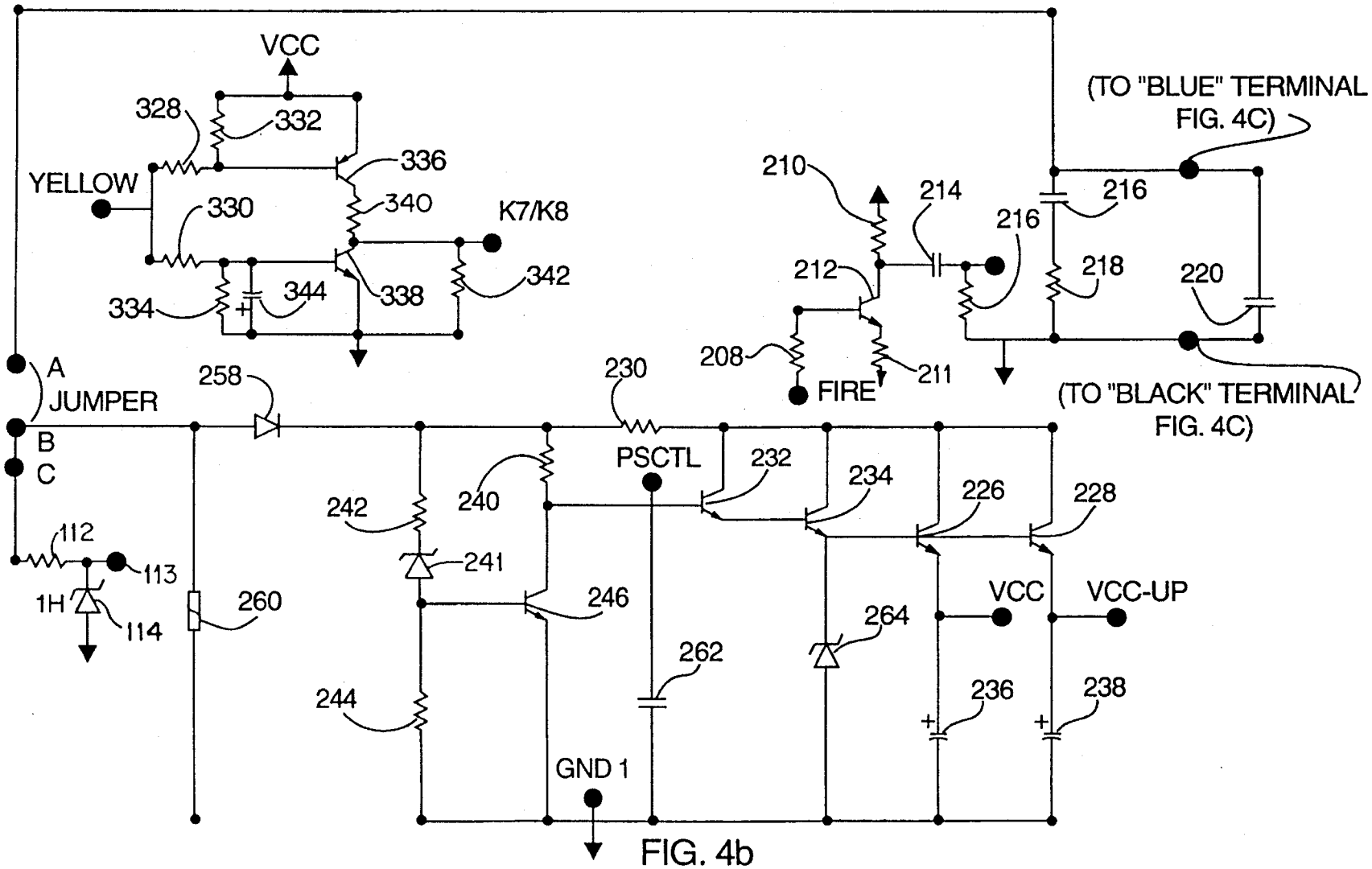
FIG. 4*b* is a schematic diagram of the power supply and triac control circuits for the dimmer of the present invention.

Referring to the power supply circuit of FIG. 4*b*, wherein terminal 113 of FIG. 4*a* is coincident with terminal 113 of the logic circuit of FIG. 4*b*, the input to the node connecting resistor 112 and diode 114 is the same AC line input which is connected to the base of transistor 110 in FIG. 4*a*. Resistor 112 functions as a voltage dropping resistor whereas diode 114 functions to prevent negative voltages from being conveyed into the system from the AC line input.

The combination of resistors 106 and 108, transistor 110, resistor 112, and diode 114 functions as a zero crossing circuit which is driven by the zero crossing points of the input wave generated by an external AC line source.

Continuing to view the logic circuit of FIG. 4*a*, resistor 118 and capacitor 120 are sized so as to produce a clock signal for the microprocessor through terminal 130. Capacitor 162 is a decoupling capacitor and capacitor 164 is a filtering capacitor for the power supply to terminal 132 of microprocessor 68.

Figure 4C:
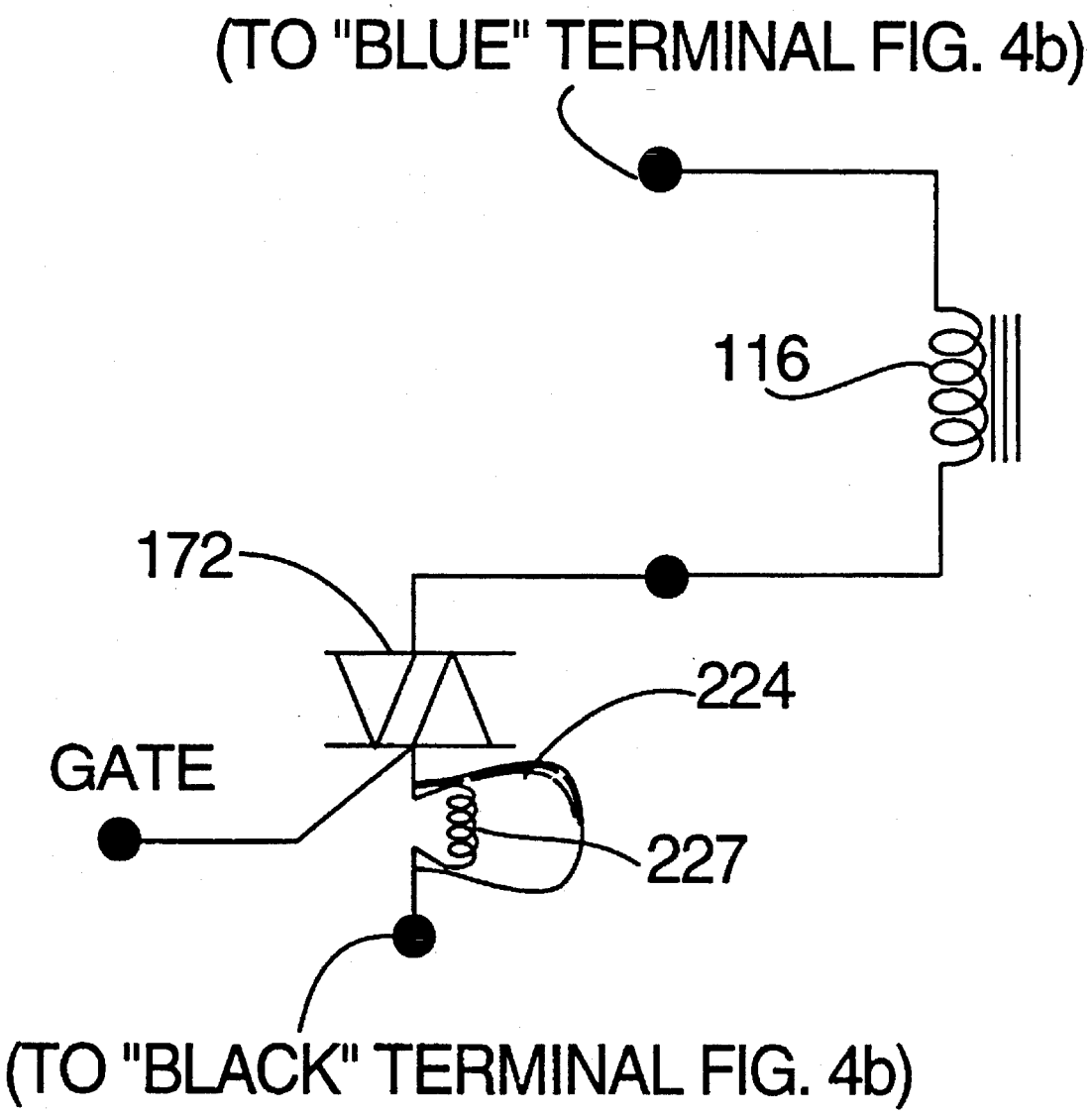
FIG. 4*c* is a schematic diagram showing the triac lamp energization circuit of the present invention.

Again referring to the logic circuit portion of FIG. 4*a*, capacitor 166, which is connected to terminal 154 of the microprocessor, resistor 168, and transistor 170 form part of the circuit for driving the triac 172 through the "FIRE" terminal which is coincident with the "FIRE" terminal shown in the power supply FIG. 4*b*. As stated previously, this circuit is connected to terminal 154 of the microprocessor. Referring to the power supply circuit portion of FIG. 4*b*, the triac triggering output from transistor 170 on the logic circuit which is designated "FIRE" of course is coincident with the input terminal to resistor 208 on the power supply circuitboard shown in FIG. 4*c* is marked "FIRE". A signal from transistor 206 passes through resistor 208 and then through the gating network for the triac 172 comprising transistor 212, resistors 210 and 216, and capacitor 214.

The gating network is designed to fire the triac with a negative gate voltage since triacs tend to respond better to triggering by negative gate voltages. In operation of the gating circuit, a voltage is accumulated across capacitor 214 through resistor 210 when the triac is not conducting. Thus, approximately 5 volts accumulates on one side of capacitor 214 while the other side is tied to ground through resistor 216. Then, when transistor 212 is fired from a signal ultimately originating at terminal 154 in microprocessor 68, the side of the capacitor which had charged to 5 volts is brought to ground and its other side, being 5 volts below it, drops to minus 5 volts. Thus, a five volt below ground pulse wide enough to fire the triac is conveyed to the gate terminal of triac 172, the triac being in series with choke coil 116. Capacitor 216, resistor 218, and capacitor 220 comprise a commonly used filtering circuit across triac 172.

Referring to the reset logic circuitry shown in FIG. 4*a*, there is also a feedback path through transistor 176 back to monitor terminal 126 of the microprocessor. There is also a pulse generated through transistor 174 and conveyed to microprocessor reset terminal 150, when power either is going down or coming up through the four volt level. Thus, when VCC runs through four volts, a pulse is sent to the microprocessor 68 to reset it. The microprocessor 68 then evaluates the signal at its monitor terminal 126 to determine whether power is going up or going down. If the microprocessor senses that power is falling, it assumes that a power outage has occurred and shuts down, i.e., it goes into a "HALT" mode. This is done to save the memory of the microprocessor regarding the preset level of the dimmer. On the other hand, if the microprocessor detects through monitor terminal 126 that power is coming up when VCC runs through four volts, the microprocessor starts itself up and first checks its memory to see whether the information contained therein was lost during the power outage. If the microprocessor senses that memory has been lost, the microprocessor sends out signals to the particular dimmer of FIGS. 5, 6, and 7 which it is controlling such that all of the lamp units are restored after the power outage in an off state and set for the maximum level of brightness should they be turned on. They will, however, brighten from a minimum setting in a "fade" or gradual manner to the maximum brightness level in order to minimize thermal shock to their filaments and also to protect against an excessive inrush current if many lamps are involved. In the case of the five key dimmer which has the capability for setting at a number of reset levels, the microprocessor will control the dimmer circuit such that the lamp brightens to 100%, 75%, 50% or 25% of its minimum level of brightness, depending on which of the four brightness level keys was last pressed.

Reiterating, the microprocessor 68 receives pulses on reset terminal 150 to indicate that VCC is passing either up or down through four volts. At the same time, a pulse is received on monitor terminal 126 to indicate whether the voltage is going up or down whereupon the microprocessor takes the aforementioned action. Resistor 178 is a pull-up resistor connected to the monitor line 126 to enable the voltage thereon to swing to the positive.

Beginning at the right of the logic circuit of FIG. 4*a*, the combination of capacitor 180, resistor 182, and resistor 184 forms a voltage divider between VCC and ground. Capacitor 180 functions to slow down abrupt changes in the circuit such that, even with a fast rise in the power supply VCC, the circuit still moves slowly such that a wide enough output pulse to trigger transistors 174 and 176 is obtained.

A distinction should be drawn between the two different VCCs in the circuit. Both VCC and VCC-UP are DC voltages generated in the power supply circuit as shown in FIG. 4*a*. VCC is a voltage that can go up and down very rapidly and will disappear if the AC power is removed for a few seconds. On the other hand, VCC-UP does not drop rapidly, even with a loss of AC power, and is only conveyed to the microprocessor 68 and a few components adjacent to the microprocessor whose voltage needs to be maintained at a high level. Thus, elements which go to VCC-UP include the aforementioned clock generating circuit comprising resistor 118 and capacitor 120, the microprocessor monitor terminal 126, and the resistor 186 which is a pull-up resistor for the reset terminal 150 of the microprocessor.

The aforementioned voltage divider circuit comprising resistors 182 and 184 is designed so as to generate a voltage high enough to forward bias transistors 188 and 174. This is accomplished by having the supply VCC at about four volts whereupon the voltage at the node between resistors 182 and 184 is approximately one (1) volt. This voltage is then applied across resistors 190 and 192 to respectively forward bias transistors 188 and 174 such that they conduct. Resistors 186, 190, 194, and 196, as well as transistor 188 combine to produce a signal at the collector of transistor 176 such that transistor 176 is set to conduct when VCC is below 4 volts whereby reset capacitor 198 will discharge to hold the reset terminal 150 of microprocessor 168 at a low level. When transistor 174 turns on, the reset terminal 16 will be switched low to a ground potential through transistors 176 and 174. Thus, as VCC goes up, transistor 176 will be forward biased but cannot conduct because transistor 174 is off. However, when VCC reaches approximately 4 volts, transistor 174 will start to conduct and thus provides a discharge path for capacitor 108 whereby it brings reset terminal 150 of microprocessor 68 to ground. However, about the time that transistor 174 starts to conduct, transistor 188 also begins to conduct which in turn shuts off transistor 176 whereby a short pulse is created. The inverse of this happens as VCC is falling through the approximately 4 volt level. As VCC falls, transistor 188 eventually stops conducting long enough for transistor 176 to conduct through transistor 174 whereupon transistor 174 shuts off so a pulse is also generated at this time. The consequences of these pulses being applied to the reset terminal 150 of microprocessor 68 have been discussed heretofore.

The circuitry comprising resistors 200 and 202 as well as transistor 206 reacts to VCC dropping below approximately 4 volts to rapidly discharge VCC such that the microprocessor is able to go into a "HALT" mode, as explained heretofore, quickly. As explained previously, when the microprocessor goes into the "HALT" mode, the memory is saved. Also, it is desirable for VCC to drop rapidly to protect the LEDs which together with the microprocessor form the main part of its load. On the other hand, VCC-UP, which has no memory saving function, follows VCC down to about 3 volts during an AC power outage and then declines at a very slow rate. Thus, if power is restored relatively quickly VCC will come up from zero to the VCC-UP level, and then the two supplies will charge together to a level above 4 volts.

Again referring to the power supply circuit of FIG. 4*b*, AC line current which can be applied to the circuit through the points marked "BLUE" and "BLACK", which are coincident with the "BLUE" and "BLACK" points of FIG. 4*c*, is used to switch on transistors 226 and 228 (through resistor 230) respectively to the circuit power supplies VCC and VCC-UP. This buildup of the voltages of VCC and VCC-UP through transistors 226 and 228 takes place for a short time during the AC waveform buildup when the voltage between the BLUE and BLACK points across the entire dimmer does not exceed about 20 volts.

In front of transistors 226 and 228 is a Darlington amplifier network comprising transistors 232 and 234 which functions to drive transistors 226 and 228 quickly into saturation to thereby charge capacitors 236 and 238.

The source of current for the Darlington amplifier network is the path through high impedance resistor 240. When the AC input gets above about 20 volts, transistor 232 shuts off. This shutoff is sensed by the voltage divider combination comprising resistors 242 and 244 whereupon the base of transistor 246 reaches about 0.7 volts when the AC voltage across the dimmer is about 20 volts. At this point transistor 246 conducts to shut down the circuit comprising transistors 232, 234, 226, and 228. Also, the base of transistor 232 is sensitive to a signal from microprocessor 66 indicating the zero crossing. This is a time based signal whereby transistor 232 is forced to shut down after one and a half milliseconds beyond the zero crossing point have elapsed. Thus the power supply portion of the circuit can be shut down either by the voltage across the dimmer exceeding 20 volts or by one and a half milliseconds having elapsed after the negative to positive zero crossing point of the AC line current wave.

Diode 258 provides half wave rectification of the incoming AC power and protects the power supply circuit from negative wave inputs. Capacitor 262 is charged from the aforementioned zero crossing sensitive circuit in the logic circuit FIG. 4*a* through terminal PSCTL, and functions, during startup of the dimmer circuit, to prevent transistors 232, 234, 226, and 228 from conducting prematurely if, for example, the dimmer circuit is energized as the AC supply voltage is peaking. Zener diode 264 is connected to the emitter of transistor 234 and functions to limit the voltage in the power supply circuit which might otherwise rise to an unacceptably high level of 15 to 20 volts which could damage microprocessor 68.

Referring again to the power supply circuit shown in FIG. 4*c*, components 328–344 comprise an interface circuit for the microprocessor 68 to one or more slave units which, as stated heretofore, operate in the same fashion as the master unit except that minimum adjustment means and LED displays are not provided thereon.

All of the slave units are connected between the points on the power supply circuit of FIG. 4*c* labeled "BLUE", and "YELLOW". Information from the slave units enters the interface at the terminal marked "YELLOW" and is conveyed to the microprocessor through the output terminal labeled "K7/K8". Thus, for example, the YELLOW terminal might receive a positive signal upon the upper rocker of a two key dimmer being pushed, and might receive a negative signal upon the lower rocker of the two key dimmer being pushed. An additional input level to the "YELLOW" terminal can be given from a three key dimmer from its on/off toggle switch.

With no signal being received on the "YELLOW" input terminal, resistors 328, 330, 332, and 334 form a voltage divider circuit which biases transistors 336 and 338 into an off state. If negative voltage is received at the "YELLOW" input terminal, the base of transistor 336 will be brought to a low enough voltage level such that the transistor will start conducting, and thus the VCC voltage will be established at terminal K7/K8 wherein it will be conveyed to terminal 124 of microprocessor 68.

Resistor 340 acts to limit the output current of transistor 336. Resistor 342 provides a high impedance path to ground at terminal K7/K8 (connected to terminal 124 of the microprocessor) and is provided to give an indication to the microprocessor 68 that no signal is being received by the "YELLOW" terminal.

If a positive voltage signal is applied to the "YELLOW" input point, transistor 338 becomes forward biased by the positive voltage and begins conducting. Thus, terminal K7/K8 (terminal 124 of the microprocessor) is firmly connected to ground through transistor 338. Microprocessor 68 can distinguish between receiving a signal from ground when transistor 338 is conducting and a ground signal which might be received through resistor 342.

Capacitor 344 performs a suppression function with respect to any noise received on the "YELLOW" line.

Figure 5:
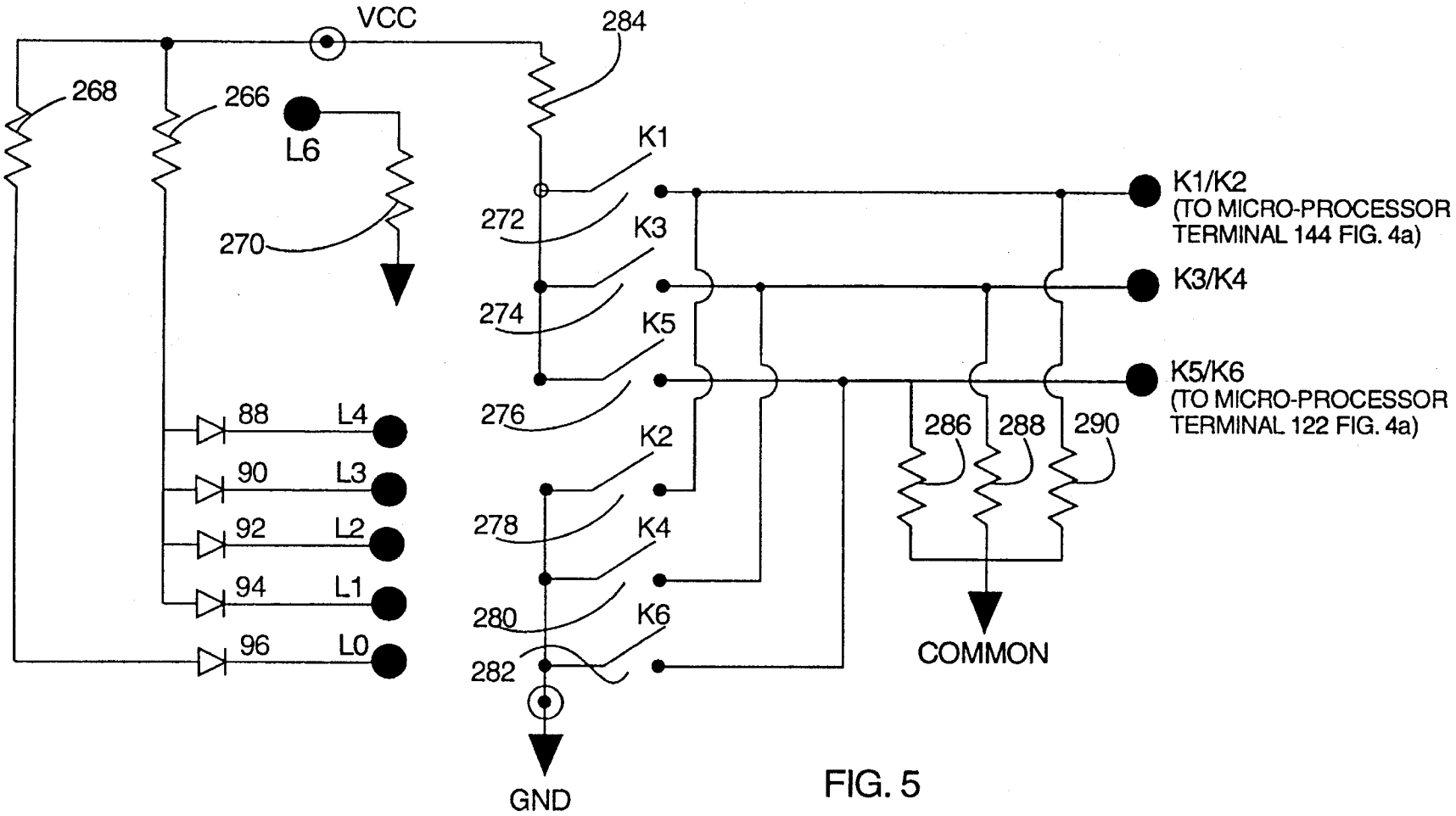
FIG. 5 is a schematic for the particular keying logic and LED circuitry for the five key dimmer of the present invention.

Referring to FIG. 5, which shows the 5 key dimmer, resistor 266 limits the current to LEDs 88, 90, 92 and 94 while resistor 268 limits the current to on/off LED 296. Resistor 270 provides, a load element on an unused terminal 156 (L6) on the microprocessor. There is no need for a load resistor equivalent to resistor 270 when the 2 key and 3 key dimmers are used since the microprocessor terminal 156 is then used to energize LEDs 60 and 86 respectively. It should also be noted that the terminal 158 labeled L5 on the microprocessor actually corresponds to terminal K3/K4 in FIG. 5, only for the 5 key dimmer.

Also shown in the 5 key dimmer circuit of FIG. 5 are 6 keys 272, 274, 276, 278, 280, and 282 with keys 272, 278, 274, and 280 representing, respectively, the four brightness levels settable by the 5 key dimmer. Key 276 represents the on/off pushbutton and key 282 is the minimum brightness adjustment lever.

Resistor 284 is a voltage dropping resistor whereas resistors 286, 288, and 290 are pull down resistors that are used for sensing the state of the switches. As shown therein, the states of two switches are being conveyed to a single terminal of the microprocessor 68.

Figure 6:
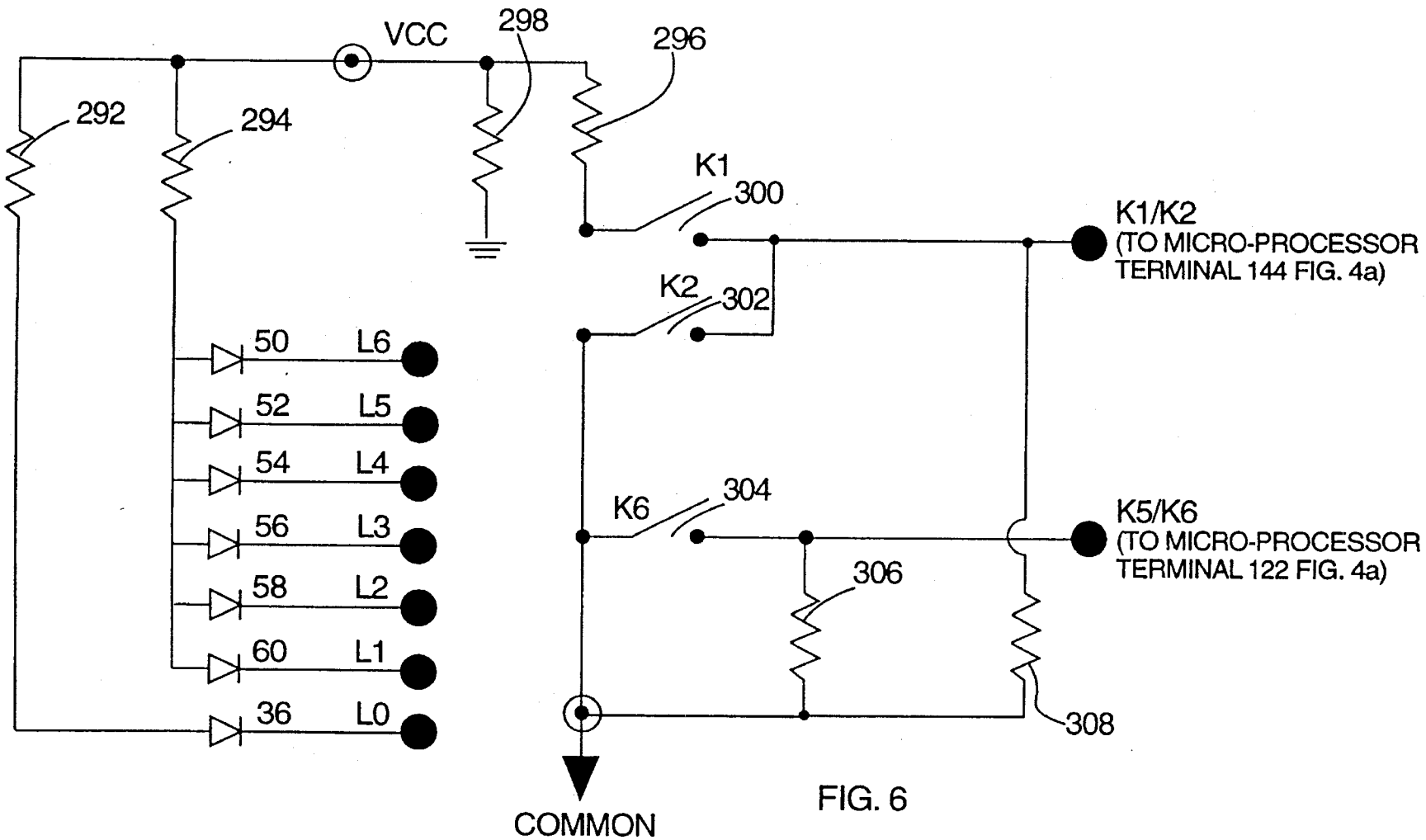
FIG. 6 is a schematic for the particular keying and LED circuitry for the two key dimmer of the present invention.

The 2 key dimmer of FIG. 6 comprises limiting resistors 292 and 294, with resistor 292 leading to on/off LED 36 and resistor 294 leading to level indicating LEDs 50, 52, 54. 56, 58, and 60. The circuit also comprises voltage dropping resistor 296 and, for the embodiment without the LEDs, resistor 298 which provides a load on the supply to effectively replace the LEDs. Key switches 300, 302, and 304, in conjunction with pulldown resistors 306 and 308, provide signals to the microprocessor 68 to indicate their respective states. Key switches 300 and 302 respectively indicate the up and down positions of the rocker 62 shown in FIGS. 1A and 10B, and key switch 304 is the minimum brightness adjustment lever.

Figure 7:
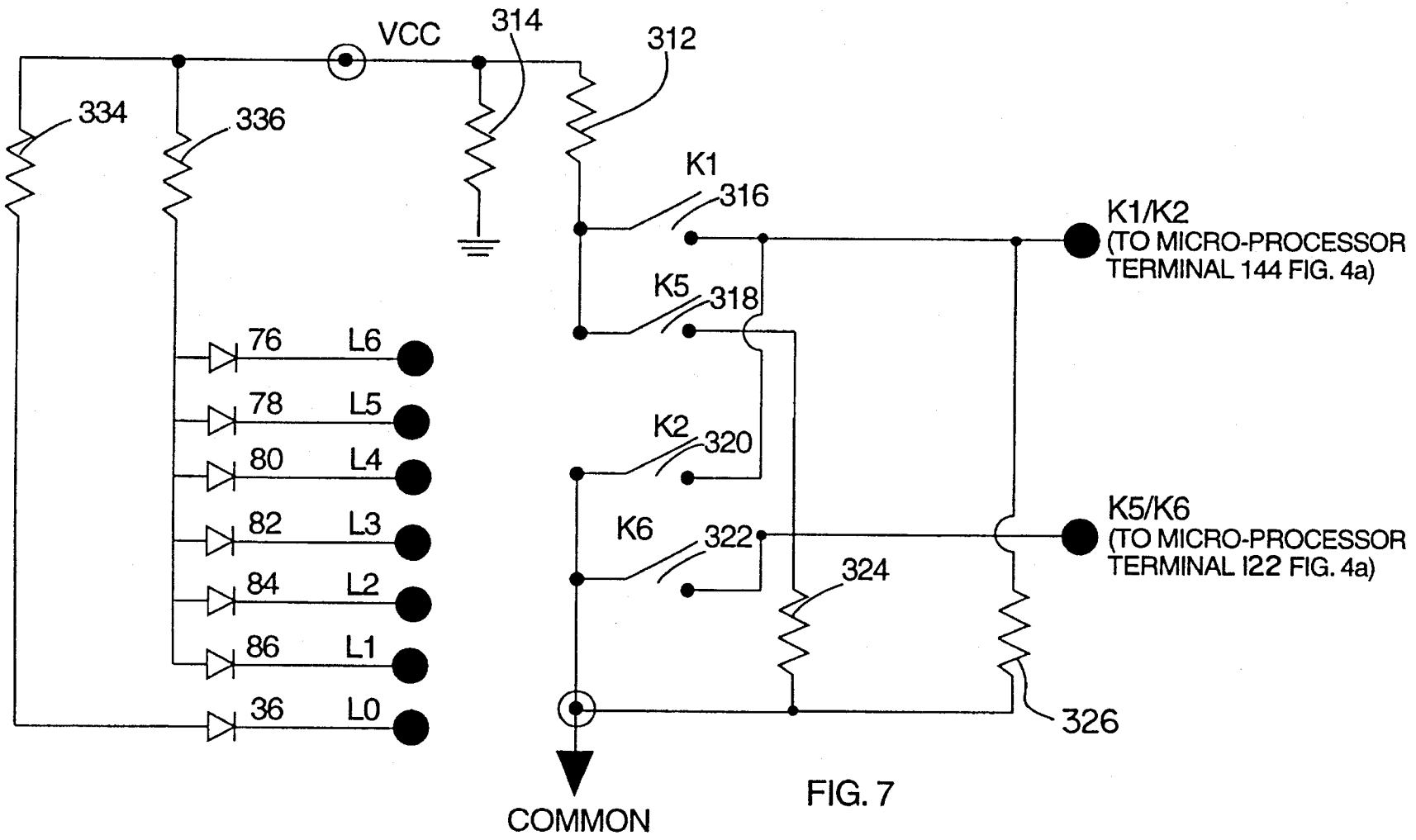
FIG. 7 is a schematic for the particular keying logic and LED circuitry for the three key dimmer of the present invention.

The 3 key dimmer of FIG. 7 functions similarly to the 2 key dimmer of FIG. 6 having current limiting resistor 310 connected to the on/off LED 36 with current limiting resistor 312 connected to level indicating LEDs 76, 78, 80, 82, 84, 86, and 88. The circuit also comprises a voltage limiting resistor 312, and, for the embodiment which does not use level indicating LEDs, resistor 314 to act as a load replacement for the LEDs. The circuit also comprises key switches 316 and 318, which respectively are indicative of the up and down positions of the rocker 62 shown, as well as a level adjustment lever 322 which is analogous to minimum brightness adjustment lever 304 of the 2 key dimmer. The 3 key dimmer also comprises an additional key 3 switch 320, which is the on/off switch for the 3 key dimmer. Pulldown resistors 324 and 326 facilitate transmission of the condition of the key switches to the microprocessor 68.

The embodiments of the invention disclosed and described in the present specification, drawings, and claims are presented merely as examples of the invention. Other embodiments, forms, and modifications thereof will suggest themselves from a reading thereof and are contemplated as coming within the scope of the present invention.

What is claimed is:

1. A touch dimmer system comprising:

latching switch means comprising an input terminal, an output terminal, and a central terminal said control terminal being adapted to have applied to it a switching signal for causing said switch means to permit current from an AC line voltage source to flow through said latching switch means during a sub-cycle of said AC line voltage, said current operating to brighten one or more lamps connected in series with said output terminal;

zero crossing circuit means for generating a zero crossing signal in response to zero crossing points of said AC line voltage source;

a microprocessor comprising a self-contained clock oscillator connected to said zero crossing circuit means to receive said signal therefrom, said micro-processor producing a triggering signal output based on its own operating clock oscillator frequency; key switch circuit means connected to said microprocessor, and said zero crossing signal;

output circuit means connected to said microprocessor to receive said triggering output signal therefrom and to thereupon generate said switching signal which is applied to said control terminal of said switching means;

power supply circuit means connected to said AC line current source and to said zero crossing circuit means, said power supply circuit means functioning to interrupt current flow through said latching switching means when voltage from said AC line voltage source reaches a certain level or when a predetermined time has elapsed since the most recent of said zero crossing points of said AC line voltage source; and one or more respective dimmer key switches for setting various lamp brightness levels and for turning said one or more lamps on or off; and comprising said key switch circuit means connected to said key switches and to said microprocessor for indicating the state of said respective dimmer key switches to said microprocessor means connected to said power supply circuit means to monitor the value of said power supply voltage and provide a monitor signal to said microprocessor; said microprocessor evaluates said monitor signal to determine whether the power supply voltage is going up above a predetermined value or going down below said predetermined value, and provides a signal to said microprocessor to reset it when the power supply voltage is at said predetermined value;

said microprocessor Upon determining that said power supply voltage is falling initiates a halt mode to save the contents of the memory of said microprocessor; said microprocessor upon determining that the supply voltage is rising starts itself up and first checks the memory of said microprocessor to see if the memory contents was lost during its shut down.

* * * * *